US009540879B2

(12) United States Patent
Kolpack et al.

(10) Patent No.: US 9,540,879 B2
(45) Date of Patent: Jan. 10, 2017

(54) DIRECTIONAL DRILLING TARGET STEERING APPARATUS AND METHOD

(71) Applicant: Merlin Technology, Inc., Kent, WA (US)

(72) Inventors: Bruce Kolpack, Bellevue, WA (US); David Bahr, Bonney Lake, WA (US); Thomas J. Hall, Bainbridge Island, WA (US); Benjamin J. Medeiros, Coeur d'Alene, ID (US)

(73) Assignee: Merlin Technology, Inc., Kent, WA (US)

( * ) Notice: Subject to any disclaimer, the term of this patent is extended or adjusted under 35 U.S.C. 154(b) by 907 days.

(21) Appl. No.: 13/725,718

(22) Filed: Dec. 21, 2012

(65) Prior Publication Data

US 2013/0175092 A1 Jul. 11, 2013

Related U.S. Application Data

(60) Provisional application No. 61/583,566, filed on Jan. 5, 2012.

(51) Int. Cl.

| | |
|---|---|
| ***E21B 7/04*** | (2006.01) |
| ***E21B 47/024*** | (2006.01) |
| ***E21B 7/06*** | (2006.01) |

(52) U.S. Cl.

CPC ..... *E21B 7/046* (2013.01); *E21B 7/06* (2013.01); *E21B 47/024* (2013.01)

(58) Field of Classification Search

CPC ..... E21B 7/04; E21B 7/06; E21B 7/046; E21B 47/024; E21B 47/12; E21B 47/022; E21B 44/00

See application file for complete search history.

(56) References Cited

U.S. PATENT DOCUMENTS 5,419,405 A * 5/1995 Patton ..... E21B 7/04 175/27

6,005,532 A 12/1999 Ng (Continued)

FOREIGN PATENT DOCUMENTS

| | | |
|---|---|---|
| CN | 1391632 | 1/2003 |
| CN | 1433498 | 7/2003 |
| CN | 101397906 | 4/2009 |
| CN | 101864943 | 10/2010 |
| JP | 4450352 | 4/2010 |

(Continued)

OTHER PUBLICATIONS

Schlumberger Oilfield Glossary, Azimuth definition, accessed Apr. 19, 2016.*

(Continued)

*Primary Examiner* — Robert E Fuller
*Assistant Examiner* — David Carroll
(74) *Attorney, Agent, or Firm* — Pritzkau Patent Group, LLC

(57) ABSTRACT

An apparatus and method are used in conjunction with a system for performing horizontal directional drilling, the system including a drill string extending from a drill rig to a boring tool such that the boring tool is steerable based on a roll orientation. The system also includes an arrangement for generating steering commands for guiding the boring tool to a target position. Responsive at least in part to the steering commands, a display is configured to selectively indicate each of a rotate command, a push command and a spin command. A steering indicator is described which indicates a current roll orientation of the boring tool. A 3-D grid can be animated and centered on either a steering or target indicator. Rounding of a steering command ratio can limit the display of target roll orientations to only those that a given boring tool transmitter is capable of sensing and indicating.

25 Claims, 9 Drawing Sheets

(56) References Cited

U.S. PATENT DOCUMENTS

| | | | | |
|---|---|---|---|---|
| 6,035,951 | A | 3/2000 | Mercer et al. | |
| 6,079,506 | A | 6/2000 | Mercer | |
| 6,250,402 | B1 | 6/2001 | Brune et al. | |
| 6,389,360 | B1 | 5/2002 | Alft et al. | |
| 6,496,008 | B1 | 12/2002 | Brune et al. | |
| 6,727,704 | B2 | 4/2004 | Brune et al. | |
| 6,868,921 | B2 | 3/2005 | Burrows et al. | |
| 7,000,710 | B1 | 2/2006 | Umbach | |
| 8,210,283 | B1 * | 7/2012 | Benson | E21B 44/00 175/26 |
| 2007/0256861 | A1 * | 11/2007 | Hulick | E21B 4/20 175/26 |
| 2010/0122847 | A1 | 5/2010 | Xia et al. | |
| 2010/0133008 | A1 * | 6/2010 | Gawski | E21B 44/02 175/45 |
| 2010/0230168 | A1 | 9/2010 | Carlson et al. | |
| 2010/0299031 | A1 * | 11/2010 | Zhdanov | E02F 3/845 701/50 |
| 2011/0174539 | A1 * | 7/2011 | Brune | E21B 47/02224 175/26 |

FOREIGN PATENT DOCUMENTS

| | | | |
|---|---|---|---|
| RU | 2215874 | C1 | 11/2003 |
| WO | 2009/086094 | A1 | 7/2009 |

OTHER PUBLICATIONS

Schlumberger Oilfield Glossary, Toolface definition, accessed Apr. 19, 2016.*

The International Search Report and The Written Opinion of the International Searching Authority for International Application No. PCT/US2013/020128 which is associated with U.S. Appl. No. 13/725,718, Apr. 4, 2013, Moscow, Russia.

The International Preliminary Report on Patentability for International Application No. PCT/US2013/020128 which is associated with U.S. Appl. No. 13/725,718, Jul. 8, 2014, Geneva, Switzerland.

The First Office Action of The State Intellectual Property Office of People's Republic of China for Chinese Application No. 201380004747.8 which is associated with International Application No. PCT/US2013/020128 which is associated with U.S. Appl. No. 13/725,718, Sep. 14, 2016. (Machine translation included).

* cited by examiner

DIRECTIONAL DRILLING TARGET STEERING APPARATUS AND METHOD

RELATED APPLICATION

The present application claims priority from U.S. Provisional Patent Application Ser. No. 61/583,566 filed on Jan. 5, 2012, which is hereby incorporated by reference in its entirety.

BACKGROUND

The present application is at least generally related to the field of underground directional drilling and, more particularly, to a directional drilling target steering system, apparatus and associated method.

A boring tool is well-known as a steerable drill head that can carry sensors, transmitters and associated electronics. The boring tool is usually controlled through a drill string that is extendable from a drill rig. The drill string is most often formed of drill pipe sections, which may be referred to hereinafter as drill rods, that are selectively attachable with one another for purposes of advancing and retracting the drill string. Steering is often accomplished using a beveled face on the drill head. Advancing the drill string while rotating should result in the boring tool traveling straight forward, whereas advancing the drill string with the bevel oriented at some fixed angle should result in deflecting the boring tool in some direction.

One prior art approach for guiding the boring tool involves what can be referred to as a homing or steering system. Generally, such a system generates steering commands that should ultimately result in the boring tool being steered to a target. Applicants recognize, however, that prior art systems have been limited in large measure to an uninterpreted display of the actual steering commands to an operator. Based solely on access to the steering commands, the skill of the operator becomes paramount in terms of correct interpretation or translation of the steering commands into drill rig machine actuations for successful guidance of the boring tool to the target location. For example, the operator has been relied on to gather information from relatively diverse sources and locations in order to properly provide input actuations to the drill rig which cause the boring tool to respond appropriately to a given steering command.

Another prior art approach for guiding the boring tool involves what can be referred to as a target path or bore plan. Such a bore plan is typically predetermined in advance of the actual horizontal directional drilling operation. The bore plan can be customized to accommodate any set of circumstances such as, for example, avoiding pre-existing utilities, structures, obstacles, and/or property boundaries. An example of such an advanced system is seen in commonly owned U.S. Pat. No. 6,035,951 (hereinafter, the '951 patent), which is hereby incorporated by reference, and described in detail with reference to FIGS. 17-19 of the patent. Each of the latter figures includes a steering coordinator 630 that can be used by the operator to guide the boring tool along a target path that is designated by the reference number 626 in FIG. 17 of the '951 patent. During drilling, the operator must translate the steering coordinator display into machine actuations to be applied to the drill rig to return the boring tool to the target path responsive to deviations therefrom and to advance the boring tool along the target path.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, an apparatus and associated methods are disclosed for use with a system for performing horizontal directional drilling including a drill string extending from a drill rig to a boring tool such that the boring tool is steerable based on a roll orientation thereof. The system includes an arrangement for generating steering commands for guiding the boring tool to a target position. In one aspect of the disclosure, a display is configured to selectively indicate each of a rotate command, a push command and a spin command responsive at least in part to the steering commands. Each of the rotate, push and spin commands can be visually indicated to an operator.

In another aspect of the disclosure, a display is configured to illustrate a steering indicator in a positional relationship with a target indicator on the display and the steering indicator is configured to present information that is representative of a current roll orientation of the boring tool in conjunction with indicating a desired steering direction to steer the boring tool to the target position.

In still another aspect of the disclosure, an apparatus and associated method are described for use with a system for performing horizontal directional drilling including a drill string extending from a drill rig to a boring tool such that the boring tool is steerable based on a roll orientation thereof and the boring tool transmits a current roll orientation signal that exhibits a given resolution to define a set of predetermined, angularly spaced apart roll orientation positions each of which can be specified by the current roll orientation signal. An apparatus and associated method involve an arrangement for generating a vertical steering command and a horizontal steering command such that a steering command ratio between the vertical steering command and the horizontal steering command defines a desired steering direction for guiding the boring tool to a target and the desired steering direction is not limited to the predetermined spaced apart roll orientations defined by the given resolution of the transmitter. A display is configured to illustrate a steering indicator in an offset positional relationship from a target indicator based on the steering commands and the steering indicator graphically presents a modified desired steering direction, that is based on the desired steering direction, at least when the desired steering direction falls between the predetermined spaced apart roll positions, and the modified steering direction corresponds to a nearest one of the predetermined roll orientation positions such that the modified desired steering direction angularly aligns with one of the predetermined spaced apart roll orientations.

In yet another aspect of the disclosure, an apparatus and associated method are described for use with a system for performing horizontal directional drilling including a drill string extending from a drill rig to a boring tool such that the boring tool is steerable based on a roll orientation thereof and the system is configured to generate steering commands such that the boring tool can home in on a target. An apparatus and associated method involve a display configured to illustrate a steering indicator in a positional relationship with a target indicator based on the steering commands. A grid pattern is illustrated on the display and originates on a selected one of the target indicator and the steering indicator.

In addition to the exemplary aspects and embodiments described above, further aspects and embodiments will become apparent by reference to the drawings and by study of the following descriptions.

BRIEF DESCRIPTION OF THE DRAWINGS

Exemplary embodiments are illustrated in referenced figures of the drawings. It is intended that the embodiments and figures disclosed herein are to be illustrative rather than limiting.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents. It is noted that the drawings are not to scale and are diagrammatic in nature in a way that is thought to best illustrate features of interest. Descriptive terminology such as, for example, up/down, right/left and the like may be adopted for purposes of enhancing the reader's understanding, with respect to the various views provided in the figures, and is in no way intended as being limiting.

Figure 1:
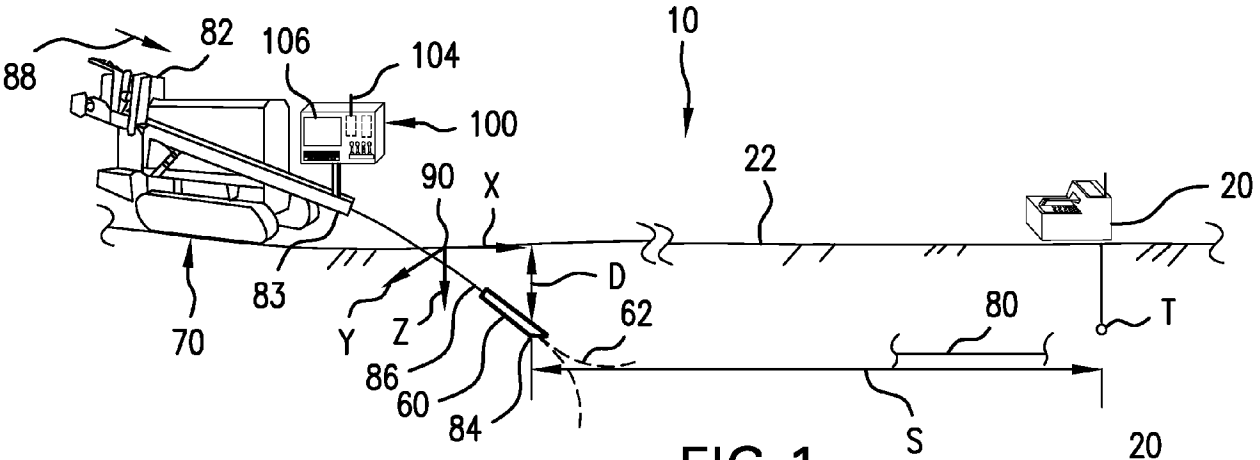
FIG. 1 is a diagrammatic view, in elevation, of a region in which a target steering apparatus and associated method, according to the present disclosure, are used for purposes of causing a boring tool to home in on a target location.
Figure 1B:
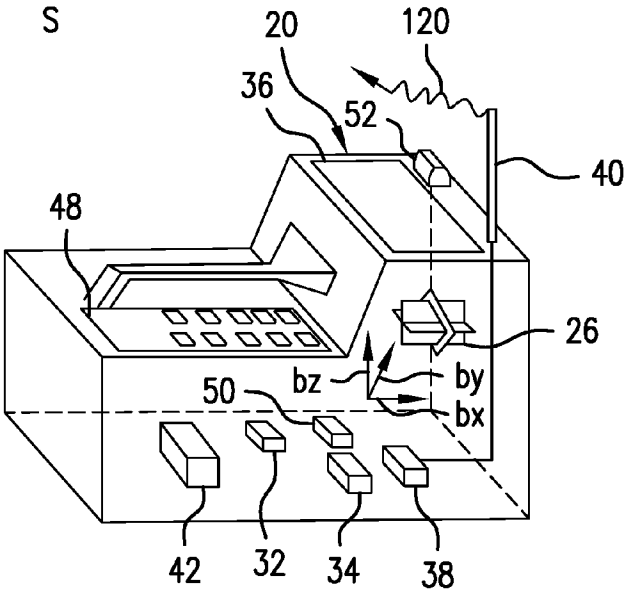
FIG. 1B is a further enlarged view showing details with respect to the control console of FIG. 1.
Figure 1A:
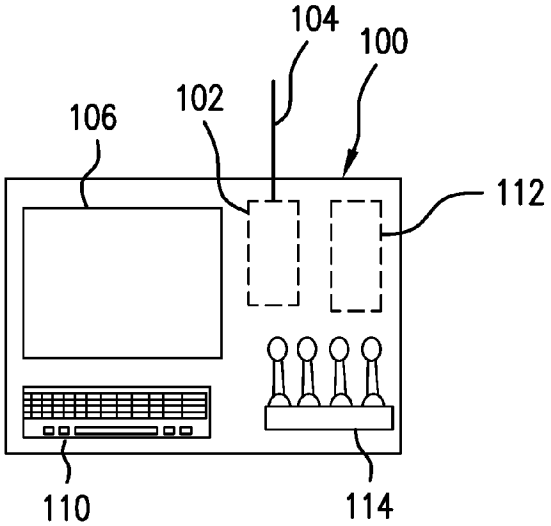
FIG. 1A is a further enlarged view showing details with respect to the portable device of FIG. 1.

Turning now to the drawings, wherein like items may be indicated by like reference numbers throughout the various figures, attention is immediately directed to FIG. 1, which illustrates one embodiment of a system for performing an inground operation, generally indicated by the reference number 10. The system includes a portable device 20 that is shown at a position on a surface 22 of the ground as well as in a further enlarged view in FIG. 1A. It is noted that inter-component cabling within device 20 has not been illustrated in order to maintain illustrative clarity, but is understood to be present and may readily be implemented by one having ordinary skill in the art in view of this overall disclosure. Device 20 includes a three-axis antenna cluster 26 measuring three orthogonally arranged components of magnetic flux indicated as $b_x$, $b_y$ and $b_z$. One useful antenna cluster contemplated for use herein is disclosed by U.S. Pat. No. 6,005,532 which is commonly owned with the present application and is incorporated herein by reference. Antenna cluster 26 is electrically connected to a receiver section 32. A tilt sensor arrangement 34 may be provided for measuring gravitational angles from which the components of flux in a level coordinate system may be determined.

Device 20 can further include a graphics display 36, a telemetry arrangement 38 having an antenna 40 and a processing section 42 interconnected appropriately with the various components. The processing section can include a digital signal processor (DSP) that is configured to execute various procedures that are needed during operation. It should be appreciated that graphics display 36 can be a touch screen in order to facilitate operator selection of various buttons that are defined on the screen and/or scrolling can be facilitated between various buttons that are defined on the screen to provide for operator selection. Such a touch screen can be used alone or in combination with an input device 48 such as, for example, a keypad. The latter can be used without the need for a touch screen. Moreover, many variations of the input device may be employed and can use scroll wheels and other suitable well-known forms of selection device. The processing section can include components such as, for example, one or more processors, memory of any appropriate type and analog to digital converters. As is well known in the art, the latter should be capable of detecting a frequency that is at least twice the frequency of the highest frequency of interest. A GPS (Global Positioning System) receiver 50 can be included along with a GPS antenna 52. The GPS components may be survey grade in order to provide enhanced position determination accuracy. Other components (not shown) may be added as desired such as, for example, a magnetometer to aid in position determination relative to the drill direction and ultrasonic transducers for measuring the height of the device above the surface of the ground.

In the present example, device 20 can be selectively configured in two different ways with respect to providing a target for a boring tool 60 that emanates a locating field 62 such as, for example, a dipole electromagnetic signal. In a first configuration, device 20 itself serves as a target. In a second configuration, device 20 can direct the boring tool to an offset target T that is located below the device. Both configurations are described, for example, in U.S. Pat. No.

Figure 3:
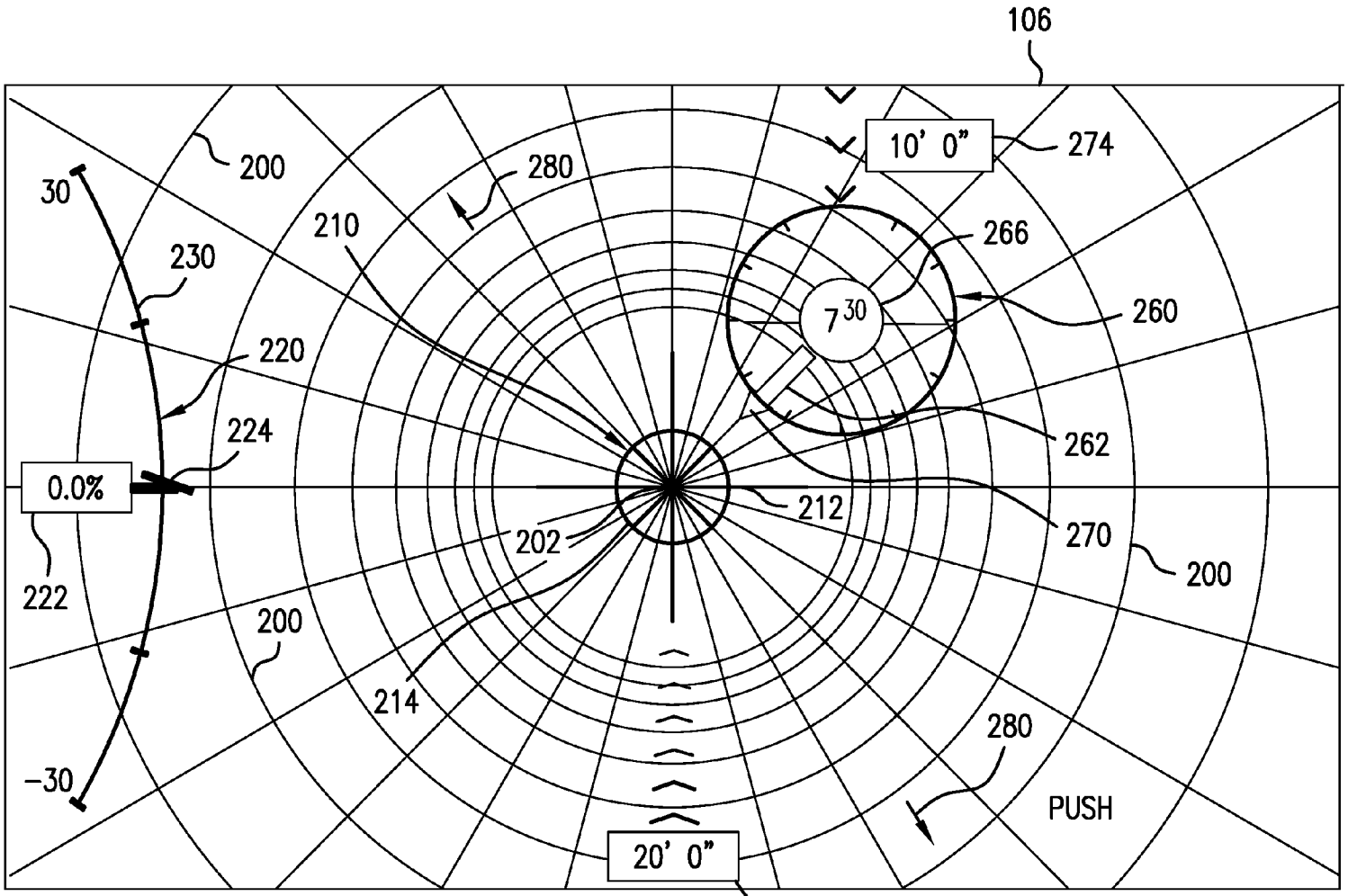
FIG. 3 is a diagrammatic screen shot illustrating the appearance of an embodiment of a push command in conjunction with additional features.
Figure 4:
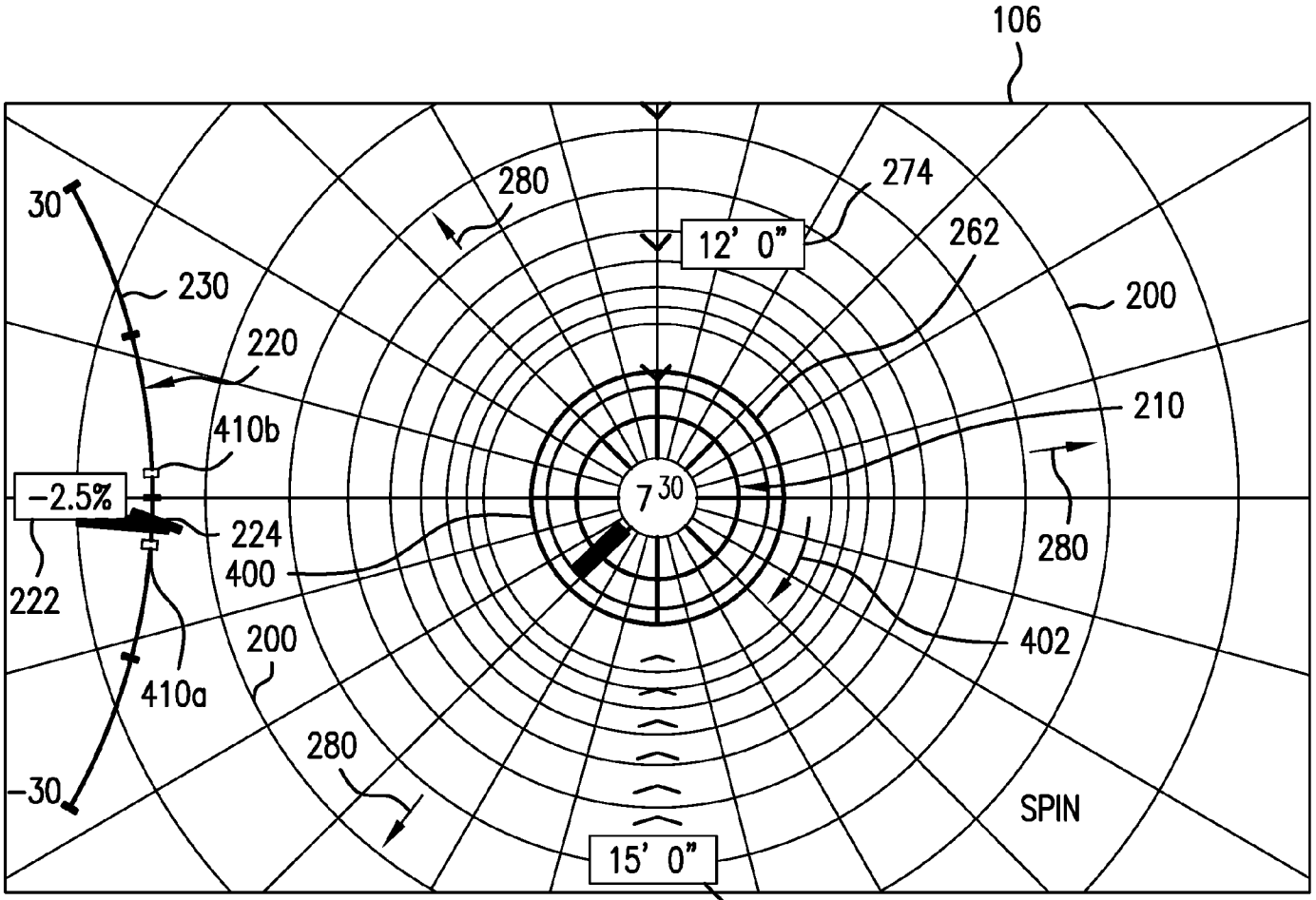
FIG. 4 is a diagrammatic screen shot illustrating the appearance of an embodiment of a spin command in conjunction with additional features.

6,250,402 (hereinafter, the '402 patent), which is commonly owned with the present application and hereby incorporated by reference, such that left/right (ΔY) and up/down (ΔZ) steering commands can be generated to guide the boring tool to either the device or to the offset target. Further, this arrangement determines a depth D of the boring tool and a horizontal distance S from the boring tool to the target, for example, in accordance with the '402 patent. U.S. Pat. No. 6,727,704, which is commonly owned with the present application and hereby incorporated by reference, brings to light still further advanced methods for generating steering commands and related information in which the location of the target is not constrained to being directly below the portable device. All of the information can be transmitted from telemetry antenna 40 of the device for use at a drill rig 70, as will be further described immediately hereinafter. In still another configuration, the target position can correspond to a position along a predetermined bore plan (i.e., target path) 80 such as is described above, for example, with regard to the '951 patent. In the present example, the target path is represented by a dashed line and is only partially shown. In yet another configuration, a portable device can utilize a joystick or other suitable mechanism that allows an operator of the portable device to directly generate drill rig actuation commands. By way of non-limiting example, one such device is described in commonly owned U.S. Pat. No. 6,079,506 (hereinafter, the '506 patent), which is hereby incorporated by reference in its entirety. In particular, handheld portable device 140 includes a joystick 148, as shown in FIGS. 3 and 4 of the '506 patent. Using such a joystick, any suitable set of drill rig actuation commands can be selectively issued to the operator at the drill rig. Irrespective of the specific technique that generates the information of interest for purposes of steering the boring tool, the techniques that are described below can utilize such information to generate drill rig actuation commands. With this overall disclosure in hand, it is considered that one of ordinary skill in the art can readily adapt any system that reasonably produces steering commands in accordance with the teachings that have been brought to light herein.

Still referring to FIG. 1, system 10 further includes drill rig 70 having a carriage 82 received for movement along the length of an opposing pair of rails 83. Boring tool 26 includes an asymmetric face 84 and is attached at an opposing end to a drill string 86. Generally, drill string 86 is made up of a plurality of removably attachable drill pipe sections such that the drill rig can force the drill string into the ground using movement in the direction of an arrow 88 and retract the drill string responsive to an opposite movement. The drill pipe sections can define a through passage for purposes of carrying a drilling mud or fluid that is emitted from the boring tool under pressure to assist in cutting through the ground as well as cooling the drill head. Generally, the drilling mud also serves to suspend and carry out cuttings to the surface along the exterior length of the drill string. Steering can be accomplished in a well known manner by orienting asymmetric face 84 such that the boring tool is deflected in a desired direction in the ground responsive to forward, push movement which can be referred to as a "push mode." Rotation or spinning of the drill string by the drill rig will generally result in forward or straight advance of the boring tool which can be referred to as a "spin" or "advance" mode.

The present example contemplates movement of the boring tool within a master XYZ coordinate system. For purposes of simplicity, in the present example, the X axis can be at least generally coextensive with the surface of the ground and lie generally above an intended path of the boring tool, however, any other suitable arrangement of coordinate axes may be adopted. The origin of the master coordinate system is specified by reference numeral 90, essentially at the point where the boring tool enters the ground. While a Cartesian coordinate system is used as the basis for the master coordinate systems employed by the various embodiments which are disclosed herein, it is to be understood that this terminology is used for descriptive purposes and that any suitable coordinate system may be used. As noted, the X axis extends forward. The Y axis extends to the right when facing in the forward direction along the X axis and the Z axis is directed downward.

The drilling operation is controlled by an operator (not shown) at a control console 100 (best seen in the enlarged view of FIG. 1B) which itself includes a telemetry receiver 102 connected with a telemetry antenna 104, a display screen 106, an input device such as a keyboard 110, a processing arrangement 112 which can include suitable interfaces and memory as well as one or more processors. For descriptive purposes and in the appended claims, it is noted that the term display can be considered to encompass a suitable apparatus that is at least capable of illustrating embodiments of the various screen illustrations that are shown in the figures. By way of non-limiting example such a suitable apparatus, for example, includes console 100 and device 20 as well as any suitable display screen that is associated or driven by a suitable processing arrangement. A plurality of control levers 114, for example, control movement of carriage 82. In an embodiment, screen 106 can be a touch screen such that keyboard 110 may be optional.

During the drilling operation, device 20 receives signal 62 using antenna array 26 and processes the received signal, for example, in accordance with the above incorporated '402 patent to generate the (ΔY) and (ΔZ) steering commands as well as depth D and distance S, all of which can be transmitted using a telemetry signal 120 to telemetry system 102 at the drill rig. It should be appreciated that locating signal 62 can be modulated in any suitable manner for purposes of carrying information to device 20. Such modulated information can include, by way of non-limiting example, orientation sensor readings such as pitch and roll orientation sensor readings, battery status, temperature, roll orientation, drilling mud pressure surrounding the boring tool and any other information of interest. It is noted that, as an alternative to modulating the locating signal, the subject information can be carried up the drill string to the drill rig using electrical conduction such as a wire-in-pipe arrangement. In either case, all information can be made available to console 100 at the drill rig. In some embodiments, it should be appreciated that steering commands can be generated without the need for a handheld portable locator. Examples of such systems are described in the above incorporated '951 patent as well as in published U.S. Patent Application no. 2011-0174539 which is commonly owned with the present application and hereby incorporated by reference in its entirety. In other embodiments, console 100 can be provided remote from the drill rig, for example, as a portable/remote unit that includes drill rig actuation controls as well as display 106.

Figure 2:
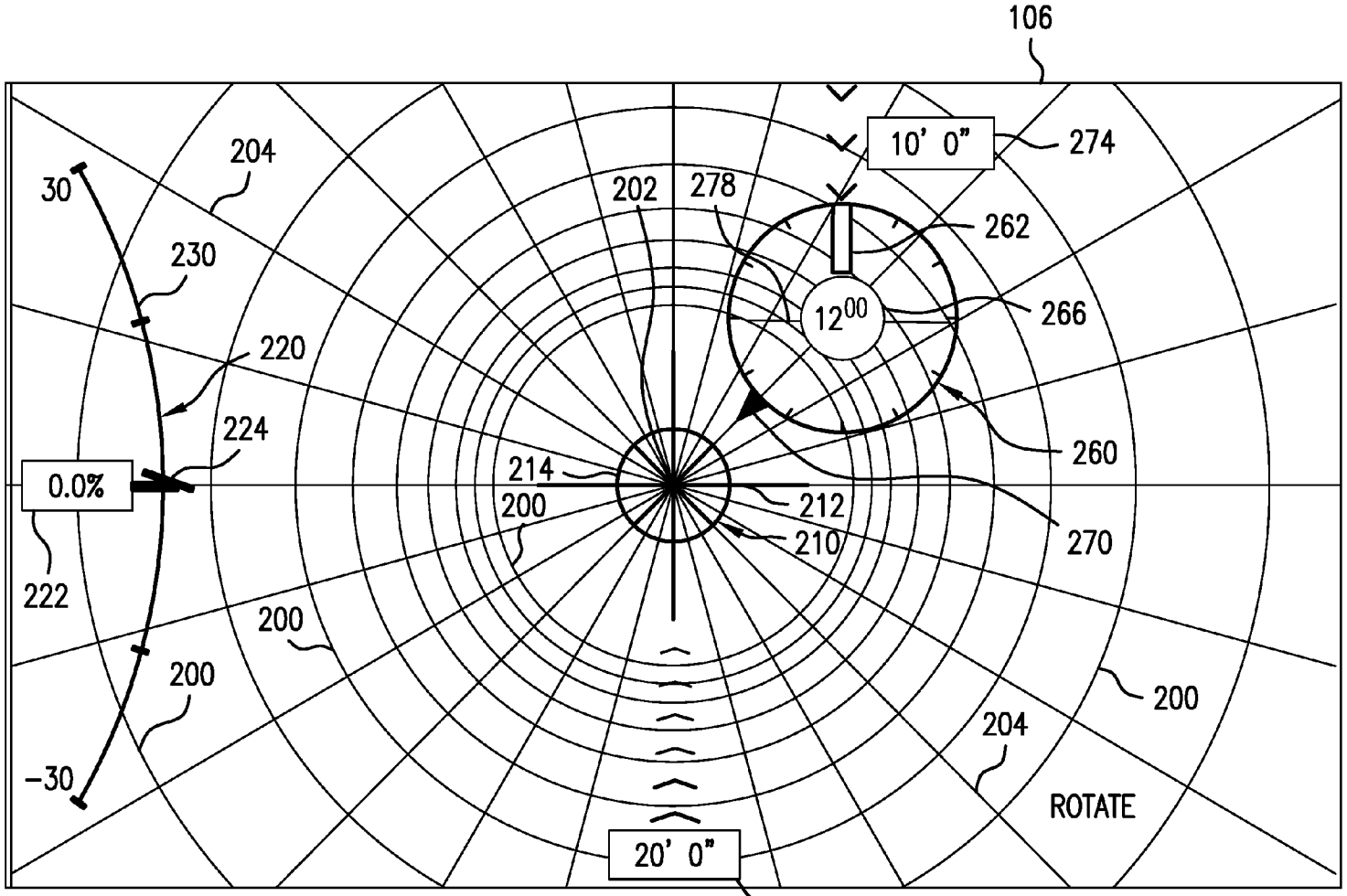
FIG. 2 is a diagrammatic screen shot illustrating the appearance of an embodiment of a rotate command in conjunction with additional features.

Attention is now directed collectively to FIGS. 2-4 which are diagrammatic illustrations of the appearance of an embodiment of a target steering application as it can appear, for example, on display 106 of FIG. 1. It should be appreciated that illustrations of the appearance of the display have been limited to black and white line drawing as a result of the constraints imposed on figures presented in the context of a patent application and its requirements, however, full color may be used on the display in any suitable manner. At least some of the features of the target steering application will be described in terms of their potential appearance on a color display. Further, some features can involve progressive movement of elements of the display in the manner of animation, for example, to simulate a 3-D (three-dimensional) appearance. In general, the display can include a series of concentric circles 200 sharing a center 202. Radial lines 204 can extend from center 202, for example, in 15 degree increments. Concentric circles 200 and radial lines 204 cooperate to simulate the appearance of a three dimensional tunnel, as will be further discussed. A target symbol 210 is also centered at 202 and can include cross-hairs 212 as well as an intersecting X shape formed within a circle 214. It is noted that the target symbol may be provided in a wide range of different configurations and is not limited to the described configuration. In some embodiments, the target position can be established based on a signal from portable device 20 while, in other embodiments, the target position can be any suitable location along a predetermined target path. While the target symbol does not move from center 202 during an ongoing drilling operation, the relative size of the target symbol can change responsive to distance of the boring tool from the actual target position, as will be further described. A pitch gauge 220 is presented near the left edge of display 106 and can present the most recent or current pitch value received at the drill rig. In the example of FIG. 2, a value of 0.0% pitch is shown as the current pitch value in a pitch window 222 adjacent to a drill head symbol 224 which is centered on a pitch arc 230. The position of drill head symbol 224 on pitch arc 230 can be based on the current pitch value. The pitch value can range at least from −30% to +30%. Generally, it is relatively rare for drilling operations to use values outside of this range. In the instance of such operation, however, the current pitch value can nevertheless be shown in pitch window 222. It should be appreciated that pitch values can be specified in terms of percent grade or degrees for any of the screen displays of the present application. Display 106 can present a current distance 240 from the target which corresponds to the current value of S, as described above. The current distance, in the example of FIG. 2, is shown as 20 feet, 0 inches. A series of chevrons can align to point in the direction of the target from the distance indication.

Having described features of the target steering display that are shared among the views of FIGS. 2-4, additional details will now be provided with respect to these individual views in conjunction with a discussion of the correspondence of each view to specific stages of the drilling operation that are involved in the overall process of instructing the operator to guide the boring tool to the target.

As will be made evident, FIG. 2 involves the presentation of a roll/pitch gauge 260 on the display, offset from target center 202 in the context of instructing to the operator to re-orient or rotate the roll orientation of the boring tool prior to proceeding. It is noted that the roll/pitch gauge may be referred to as a steering indicator. Thus, the illustration of FIG. 2 can be considered as being representative of a rotate or roll command mode. In an embodiment, the word "ROTATE" or other suitable textual indication can be displayed to convey the current actuation command, although this is not a requirement. The textual indication can be framed and/or presented using any suitable combination of color and/or animated graphical elements. In another embodiment, a different display screen can be presented prior to the appearance of the screen of FIG. 2 including a larger textual indication to emphasize to the operator that the actuation command is changing, as is likewise the case with other textual indications described below. For purposes of FIG. 2, it can be assumed that the boring tool is stationary. The roll/pitch gauge, in the present embodiment, is shown generally in the form of a clock face having 12 circumferential positions. A roll bar 262 can show the current roll orientation of the boring tool, for example, as decoded from telemetry signal 120 (FIG. 1). The current roll orientation can also be shown, for example, in a roll bubble 266 at the center of the clock face. In the present example, the current roll orientation is indicated as 12:00 o'clock. Further, roll/pitch gauge 260 is angularly spaced and offset from center 202 in a way that is intended to intuitively demonstrate the current status of the boring tool, as uniquely represented by the roll/pitch gauge itself, relative to the target in terms of roll input that is needed from the operator. A graphical indication can be provided, for example, in the form of a caret 270 on the periphery of the roll/pitch gauge to indicate the angular orientation of the roll/pitch gauge with reference to the clock positions thereon. That is, the roll/pitch gauge is angularly offset from the target in a manner that is intended to represent the view that would be seen by the operator if the operator were able to look at least generally down the length of the drill string toward the target. Further, the roll/pitch gauge graphically and numerically shows the current roll orientation of the boring tool to the operator. Thus, the roll/pitch gauge presentation described herein consolidates a significant amount of information into one convenient and easy to interpret view. It is noted that the angular offset can be determined based on the inverse tangent of ($\Delta Z/\Delta Y$), the ratio of vertical steering command $\Delta Z$ to lateral steering command $\Delta Y$ wherein the steering commands are available via telemetry signal 120.

Still referring to FIG. 2, a depth indication 274 can be provided in conjunction with the roll/pitch gauge to indicate the current depth of the boring tool as decoded from telemetry signal 120. In the present embodiment, the depth indication is shown in a window adjacent to a number of inverted chevrons that are spaced apart between the upper edge of the display and the upper periphery of the roll/pitch gauge. It should be appreciated that the depth indication and associated inverted chevrons move in concert with movement of the roll/pitch gauge around center 202, based on the steering commands. For purposes of indicating to the operator that adjustment of roll orientation is needed, the display can call the attention of the operator to roll bar 262 in any suitable manner. For example, the roll bar can be red in color, flash and/or be animated using some combination of features. At the same time, caret 270 may exhibit the same behavior as the roll bar or any suitable behavior using color, animation and the like to indicate to the operator that a roll input is needed. Further indications can be provided to the operator, for example, based on the appearance and/or color of the clock face of the roll/pitch gauge. For example, the clock face or some limited portion of the clock face can be shaded yellow or some variant thereof which can be maintained so long as roll bar 262 is not aligned with caret 270. Aural indication of the need for a roll input may also be provided. Responsive to this indication, the operator can rotate the drill string with the intention of aligning roll bar 262 with caret 270. With rolling the boring tool, the roll bar rotates around the roll/pitch gauge in a manner that will be described in further detail below. In an embodiment, the position of the steering coordinator 260 can be established based on the magnitudes and signs of the X and Y steering commands. In some embodiments, a roll indicator can be provided separate from the steering coordinator, for example, on a clock face that appears proximate to one corner of the display.

FIG. 2 further serves to introduce a pitch indicator 278 that extends across the clock face of the gauge. The pitch indicator can be referred to interchangeably as a pitch horizon. Since the current pitch reading in FIG. 2 is zero degrees, the pitch indicator bisects the clock face. As will be seen in subsequent figures, the pitch indicator can move vertically on the roll/pitch gauge responsive to changes in the pitch orientation. Further, any suitable scheme can be used to define the current pitch reading, including, for example, color shading that defines a boundary corresponding to the proper location of the pitch horizon.

FIG. 3 demonstrates an embodiment of the appearance of display 106 responsive to the operator having rolled the drill string to bring roll bar 262 into alignment with caret 270 which indicates a push or advance command to the operator to push or advance the drill rod further into the ground without rotation. In an embodiment, the word "PUSH" or other suitable textual indication can be displayed to convey the current actuation command, although this is not a requirement. The textual indication can be framed and/or presented using any suitable combination of color and/or animated graphical elements. If the operator misses the aligned condition, for example, due to wrap-up in the drill string, the operator can simply continue to rotate the drill string any number of revolutions until alignment is achieved. Responsive to achieving the aligned condition of the roll bar and caret, the color scheme can change. For example, the roll bar and/or the caret can turn green and/or exhibit any suitable behavior such as, for example, flashing to indicate to the operator that the drill string should be advanced without rotation. The boring tool can then be advanced until indicated otherwise. During such advancement, the elements of display 106 can respond in a way that indicates to the operator that the boring tool is moving toward the target. In one feature, circles 200 can expand in diameter as indicated by arrows 280. Similarly, circles 200 can be animated to reduce in diameter responsive to retraction of the drill string.

Still referring to FIG. 3, it is appropriate to now consider a number of details with respect to bringing roll bar 262 into alignment with caret 270. In an embodiment, roll/pitch gauge 260, along with caret 270, can be positioned at any angular orientation that is defined in terms of the current steering command ratio. Depending upon the roll orientation sensing capabilities of a particular transmitter that is in use in boring tool 60, however, the result can be that it is not possible to achieve perfect alignment between the roll bar and caret. In such an embodiment, other indications such as color and/or animation can indicate to the operator that it is appropriate to advance the drill string despite some degree of misalignment between the roll bar and caret. In another embodiment, however, positioning of roll/pitch gauge 260 and caret 270, based on the current steering command ratio, can be accomplished in view of the roll orientation sensing capabilities of the particular transmitter that is used in boring tool 60. That is, a given transmitter generally includes a roll orientation sensor or sensing arrangement having a limited resolution. For example, transmitters are available having 12 position (i.e., clock position) roll orientation sensing and 24 position (½ clock position) roll orientation sensing. For a constant roll rate, progression of roll bar 262 around the roll/pitch gauge proceeds in a stepwise fashion from one sensed roll position to the next. Generally, the current sensed position can be rounded, based on the telemetry signal, to the nearest available roll orientation that can be indicated. Stated in another way, roll/pitch gauge 260 and/or caret 270, can be positionally limited to angular orientations that correspond to or match positions that a given transmitter is capable of sensing by subjecting the current steering command ratio to rounding. Accordingly, roll/pitch gauge 260 and caret 270 can be located at uniformly spaced apart angular positions around center 202 that correspond to the roll orientations that can be indicated or sensed by the transmitter that is in use. In this way, each of the roll positions that can be indicated on roll/pitch gauge 262 can be brought into or achieve an aligned condition with caret 270. Accordingly, a display can be configured to illustrate a steering indicator in an offset positional relationship from a target indicator based on the steering commands such that the steering indicator graphically presents a modified desired steering direction. The modified steering direction is based on the desired steering direction such that when the desired steering direction falls between the predetermined spaced apart roll positions, the modified steering direction can correspond to a nearest one of the predetermined roll orientation positions to angularly align the modified steering direction with one of the predetermined spaced apart roll orientations.

Turning to FIG. 4, an embodiment of the appearance of display 106 is illustrated responsive to the operator having steered the boring tool onto a direct path toward the target. That is, the boring tool should hit the target by spinning the drill string while pushing in the "spin" mode. The appearance of screen 106 in FIG. 4 can be considered as providing a spin command to the operator. In an embodiment, the word "SPIN" or other suitable textual indication can be displayed to convey the current actuation command, although this is not a requirement. The textual indication can be framed and/or presented using any suitable combination of color and/or animated graphical elements. The spin mode can be entered, for example, responsive to both steering commands $\Delta Y$ and $\Delta Z$ reducing to less than or equal to a selected threshold value. A suitable threshold value, by way of non-limiting example, can be selected as a steering command of +/−5 units for a transmitter having a given range of 256 units for each steering command. Once either steering command violates the threshold, the display can revert to either the rotate command or push command modes of FIGS. 2 and 3, respectively. The display can toggle between the various command modes, as needed. It is noted that distance 240, to the target, is shown as having decreased to 15 feet, 0 inches while depth 274 is shown as having increased to 12 feet, 0 inches. Drill head symbol 224 is shown at a position on pitch arc 230 that corresponds to the current pitch value of −2.5 percent which is likewise shown in pitch window 222.

Still referring to FIG. 4, the appearance of the display can change in any suitable manner upon entering the spin command mode. In an embodiment, target symbol 210 can increase in size (i.e., diameter) while being centered within roll/pitch gauge 262. The latter can itself change in appearance. In an embodiment, an outer ring 400 of the roll/pitch gauge can change in color relative to its appearance in the screens of FIGS. 2 and 3 such as, for example, transforming to a green circular band. Outer ring 400 can be animated, for example, to include rotating sections and/or color shading which rotation is indicated by an arrow 402 to demonstrate to the operator that rotation of the drill string is desired. As another feature, it is noted that caret 270 can disappear upon entering this display mode.

FIG. 4 additionally illustrates one embodiment of the appearance of pitch trending indicators 410*a* and 410*b* which can be referred to collectively using the reference number 410. In the present example, minimum pitch indicator 410*a* specifies −2% while maximum pitch indicator 410*b* specifies +5%. The minimum and maximum values can be determined in any suitable manner. In one embodiment, the minimum and maximum pitch value can be specified as corresponding values measured within some time period extending up to present time, for example, within the last ten seconds. In another embodiment, the minimum and maximum pitch values can be selected from a predetermined number of the most recent pitch values such as, for example, the last thirty pitch readings. The pitch trending indicators can be indicative of drilling conditions. For example, when the boring tool is subject to a high degree of vibration, the pitch trend indicators generally will diverge from one another. Subject to relatively smooth operation, the pitch trend indicators generally will converge. In the event that the boring tool has been deflected responsive to striking an obstacle such as a rock, one of the pitch trending indications can correspond to the currently indicated pitch reading for the boring tool. The pitch trending indicators can also be useful, for example, to demonstrate that the bore is on-grade under circumstances when individual pitch readings can be quite variable.

With reference to FIGS. 2-4 and as will be shown in additional figures, pitch information can also be provided as part of roll/pitch gauge 262. In an embodiment, a "horizon" on the roll/pitch gauge can move vertically responsive to the current pitch reading such that the horizon bisects the roll/pitch gauge at zero pitch, moves up as pitch becomes more negative and moves down as pitch becomes more positive. Any suitable scheme can be used to define the pitch horizon, including, for example, color shading.

Figure 5:
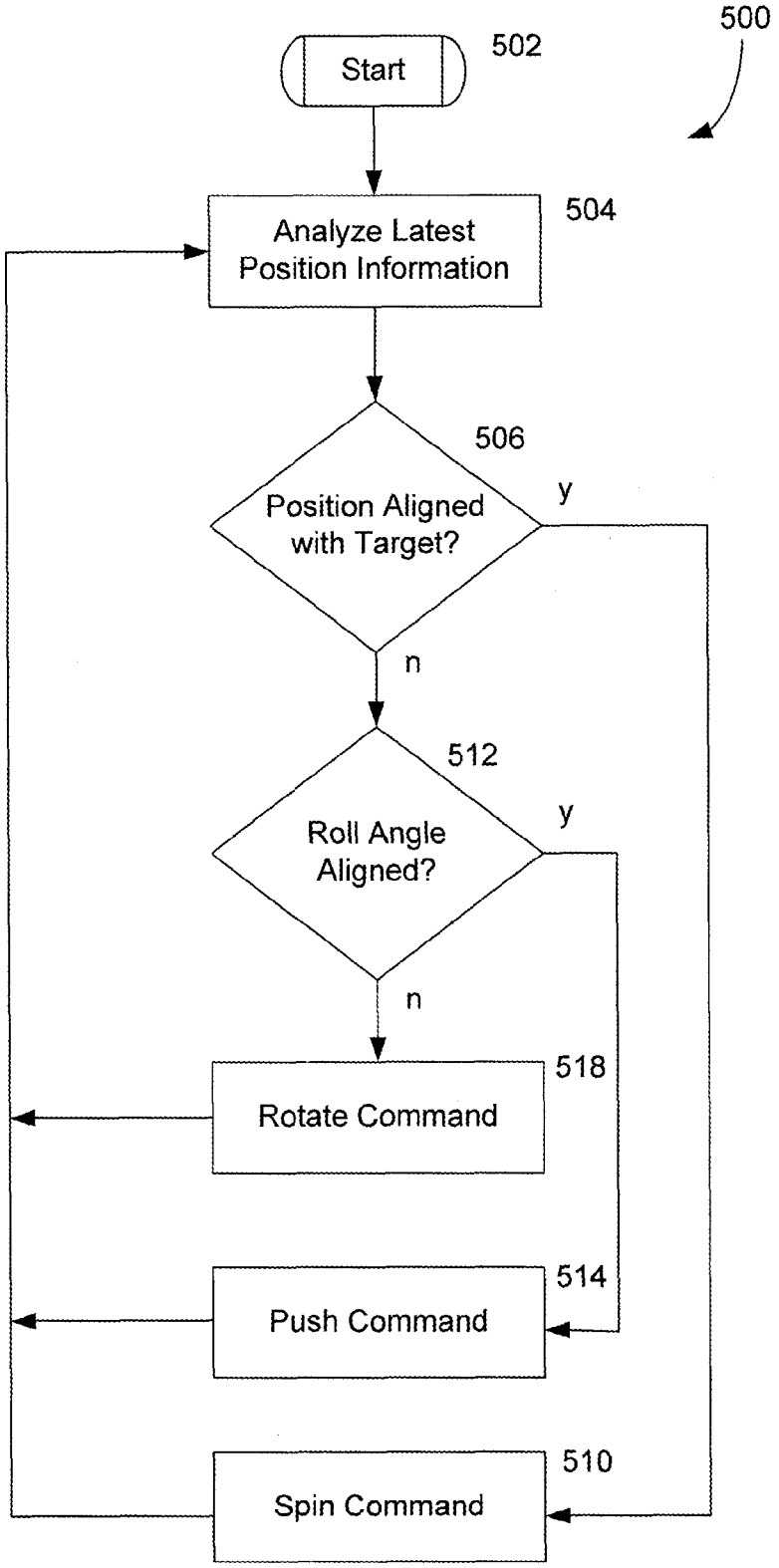
FIG. 5 is a flow diagram that illustrates an embodiment of a method for the operation of a target steering method according to the present disclosure.

FIG. 5 is a flow diagram, generally indicated by the reference number 500, which illustrates an embodiment for the operation of the target steering application according to the present disclosure. The method begins at 502 and proceeds to 504 which analyzes the most recent boring tool position and related information received, for example, via telemetry signal 120. In some embodiments, at least some information such as, for example, sensor-based orientation readings, may be received at the drill rig via data transmission that utilizes the drill string. At 506, a test determines whether the boring tool is aligned with the target. Such a determination can be based, for example, on the magnitudes of the steering commands in view of a threshold value, as discussed above. Alignment can be determined on the basis of the angular resolution provided by the steering commands in view of the number of roll positions that can be detected by a given transmitter. For example, the steering commands can be rounded to the nearest roll orientation that can be detected/indicated by the given transmitter. If the boring tool is aligned, operation proceeds to 510 such that display 106 can issue the spin command, for example, based on its appearance in FIG. 4. On the other hand, if the boring tool is not aligned with the target, operation next proceeds to an appropriate one of the rotate command (FIG. 2) or the push command (FIG. 3). Accordingly, step 512 tests whether the current roll orientation angle of the boring tool is aligned with the direction in which steering is needed based on the steering command ratio in a manner that is consistent with presentation of the push command, for example, as seen in FIG. 3. As described above, the steering commands can be rounded to the nearest roll orientation that can be indicated by a given transmitter. If alignment is appropriate, operation proceeds to 514 such that the push command screen of FIG. 3 or its equivalent can be presented to the operator. If alignment is not appropriate, operation proceeds to 518 such that the rotate command screen of FIG. 2 or its equivalent can be presented to the operator. Subsequent to each of spin command 510, push command 514 and rotate command 518, operation returns to 504. The described process can repeat in an iterative manner until the boring tool arrives at the target. Iterations of the process can be performed at any suitable rate for purposes of updating the display. In an embodiment, the iteration rate can be based on the rotation rate of the drill string. In some embodiments, iterations can be performed at a rapid rate which is limited by constraints that are imposed by system hardware. For example, an iteration can be performed each time that a roll update is received from the inground transmitter electronics.

Figure 6:
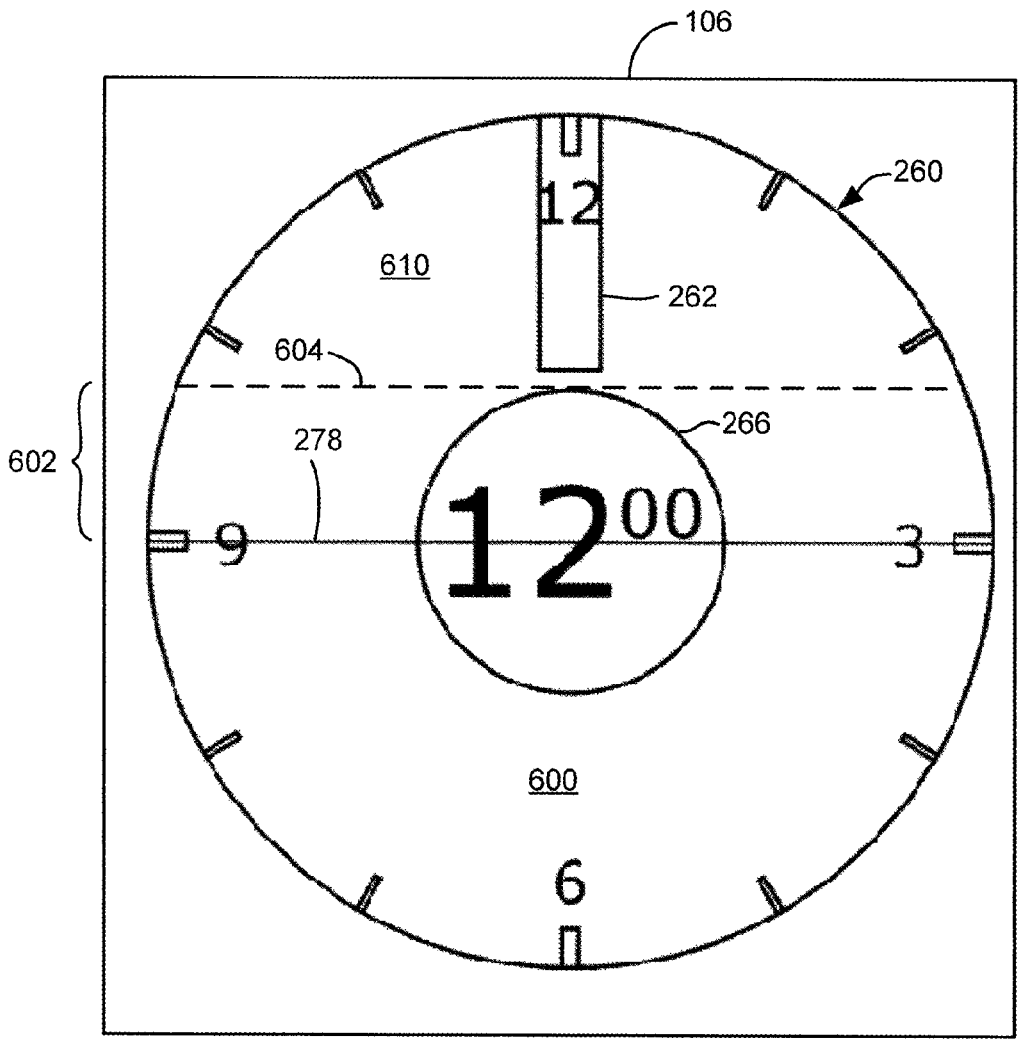
FIG. 6 is a diagrammatic screen shot illustrating the appearance of an embodiment of a steering indicator according to the present disclosure.

Referring to FIG. 6, attention is now directed to further details with respect to roll/pitch gauge 260. Initially, it is noted that the roll/pitch gauge can be presented on display 106 as part of an overall target steering display, as seen in FIGS. 2-4, or individually on display 106, as seen in FIG. 6 and/or on display 36 of device 20. The appearance of the roll/pitch gauge can be identical in either case, however, at least certain features admit of greater illustrative clarity using independent views of the roll/pitch gauge, the largest of which is the subject of the present discussion. The appearance of roll/pitch gauge 260 corresponds at least generally to its appearance in FIG. 2 including roll bubble 266 indicating a 12:00 o'clock roll indication having roll bar 262 aligned at the 12:00 o'clock position. While the roll bar is shown as being transparent to illustrate the underlying clock face, the roll bar can be of any suitable color and may block the view of the clock face therebeneath. Pitch indicator 278, in the present example, specifies that the current pitch reading is zero percent. As discussed above, the location of the pitch indicator can serve as a boundary between different regions of color. For example, a region 600 below the pitch indicator can be dark or black in color while the region above can be lighter in color. In an embodiment, a transition zone or region 602, above the location of pitch indicator 278 and having an upper boundary defined by a dashed line 604, can be progressively shaded, for example, from white proximate to the pitch indicator location to a golden hue at the top margin of the region that fades out almost entirely upon reaching upper boundary 604. An upper portion 610 of the clock face can be of a different color such as, for example, blue. As will be seen, the proportion of each of the different color regions on the clock face of the roll/pitch gauge can change responsive to changes in the pitch angle. Region 602 can move vertically in concert with movement of pitch indicator 278. The vertical width of region 602 can change responsive to the current pitch value. For example, as the pitch increases in the positive direction, the region can become more narrow vertically. Conversely, as the pitch increases in the negative direction, the region can broaden vertically or remain unchanged. Numerical indications can be provided for selected positions on the clock face, for example, as shown. Color schemes can be selected to maintain visibility of roll bubble 266 in embodiments that apply shading to the roll bubble based on the colors applied to regions 600, 602 and 610.

Figure 7:
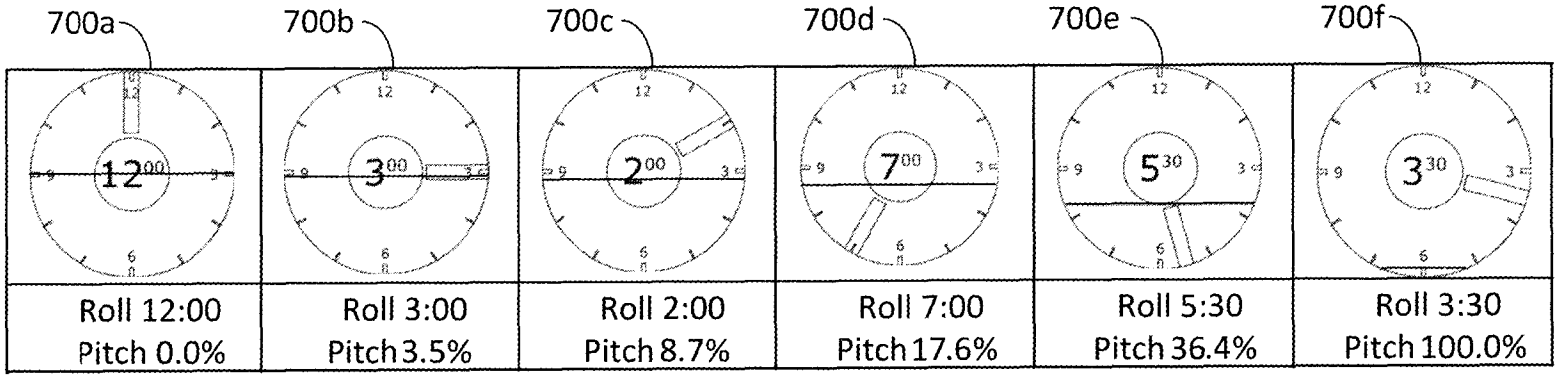
FIG. 7 diagrammatically illustrates the appearance of embodiments of a screen shot of a steering indicator of the present disclosure for progressively increasing pitch values.

FIG. 7 presents embodiments of the appearance of the roll/pitch gauge on display 106 for increasingly positive pitch values, designated by the reference numbers 700*a-f*, each of which is captioned with the illustrated pitch value and the indicated roll value. It should be appreciated that the various regions described above with reference to FIG. 6 can readily be provided for each of these screenshots. By way of non-limiting example, the location of the pitch indicator line can be determined for a standard coordinate system by taking the negative of the current pitch value in degrees and then multiplying by a constant that is based at least in part on the height of the gauge.

Figure 8:
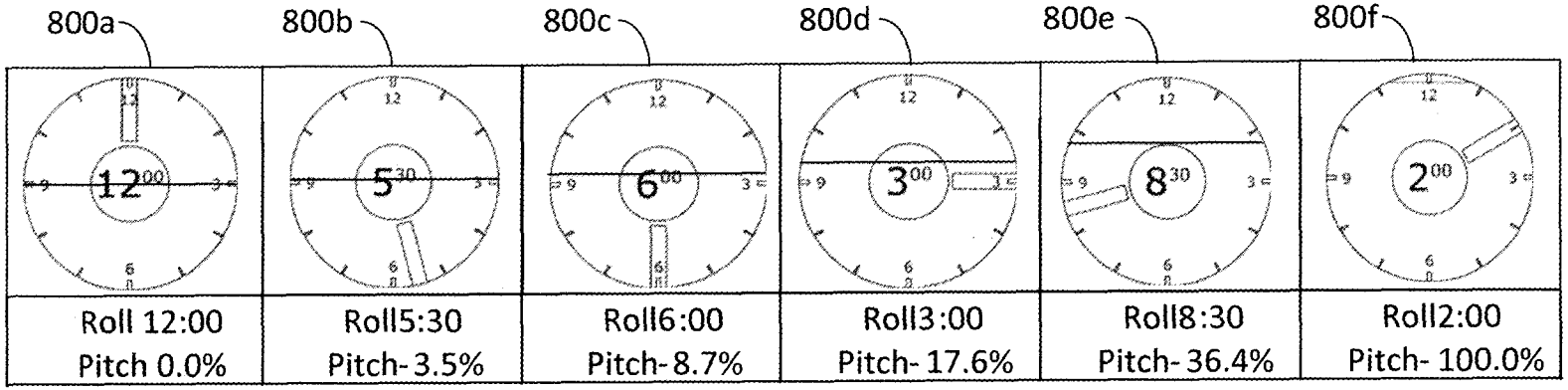
FIG. 8 diagrammatically illustrates the appearance of embodiments of a screen shot of a steering indicator of the present disclosure for progressively decreasing pitch values.

FIG. 8 presents embodiments of the appearance of the roll/pitch gauge on display 106 for increasingly negative pitch values, designated by the reference numbers 800*a-f*, each of which is captioned with the illustrated pitch value and the indicated roll value. It should be appreciated that the various regions described above with reference to FIG. 6 can readily be provided for each of these screenshots.

Figure 9:
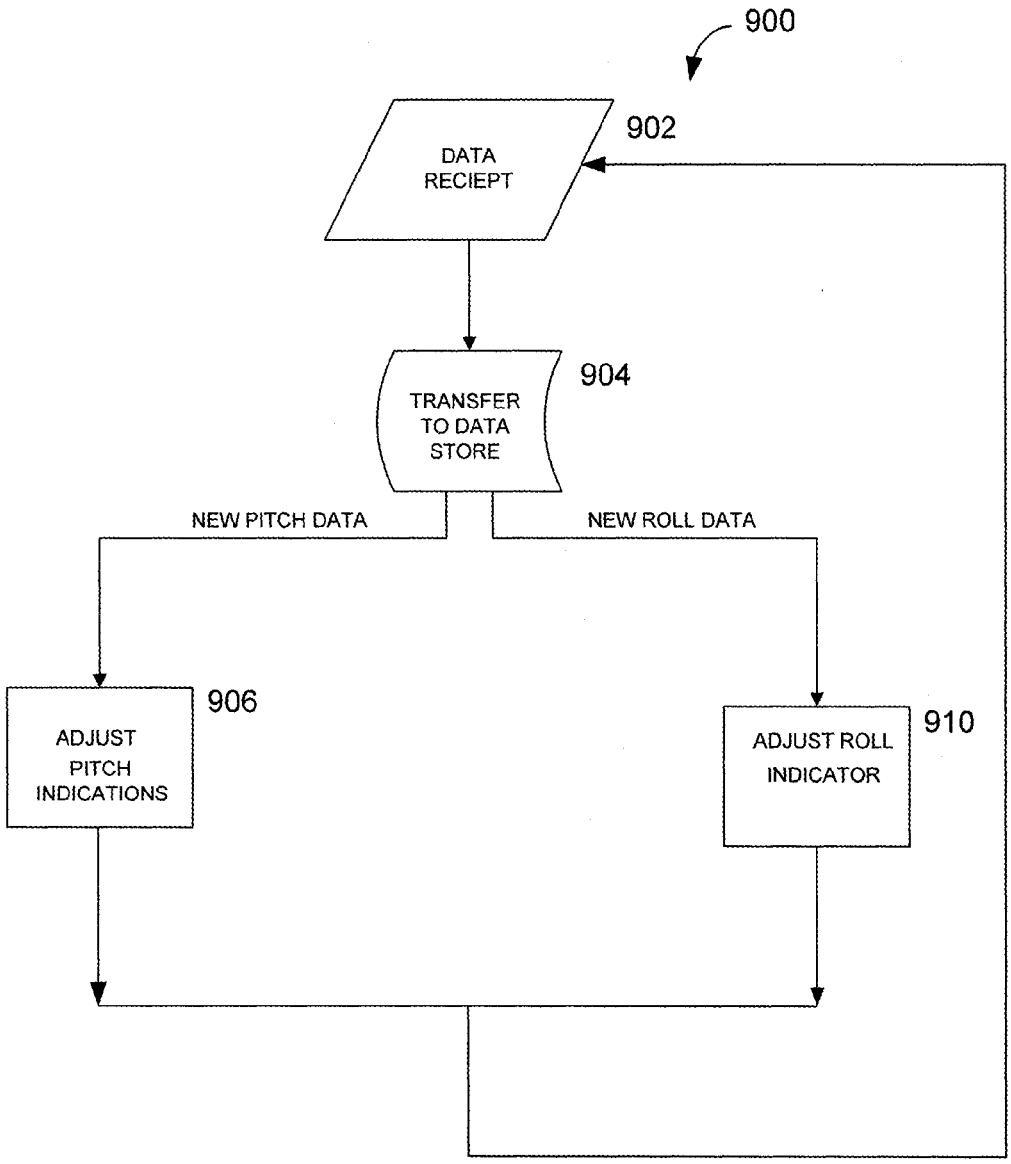
FIG. 9 is a flow diagram that illustrates an embodiment of a method for generating the steering indicator of the present disclosure.

Turning to FIG. 9, an embodiment of a method, generally indicated by the reference number 900, is illustrated for generating the roll/pitch gauge as seen in the various figures. At 902, data is received which can include pitch data and roll data. As described above, such data can be received via telemetry and/or in any other suitable manner such as by transmission from the boring tool up to the drill rig via the drill string. The received data is decoded and can be transferred at 904 to a data store. The latter, for example, can be located in memory at console 100 on the drill rig. New pitch data is then used at 906 for adjusting the pitch indications as reflected by pitch gauge 220 (FIGS. 2-4), pitch trending indicators (410*a* and 410*b* in FIG. 4) and the roll/pitch gauges seen in FIGS. 2-4 and 5-8. New roll data can likewise be used at 910 for adjusting the roll indications as reflected by the roll/pitch gauges seen in FIGS. 2-4 and 5-8. Subsequent to steps 906 and 910, operation returns to 902 and can proceed in this loop throughout the operation of the system.

Figure 10:
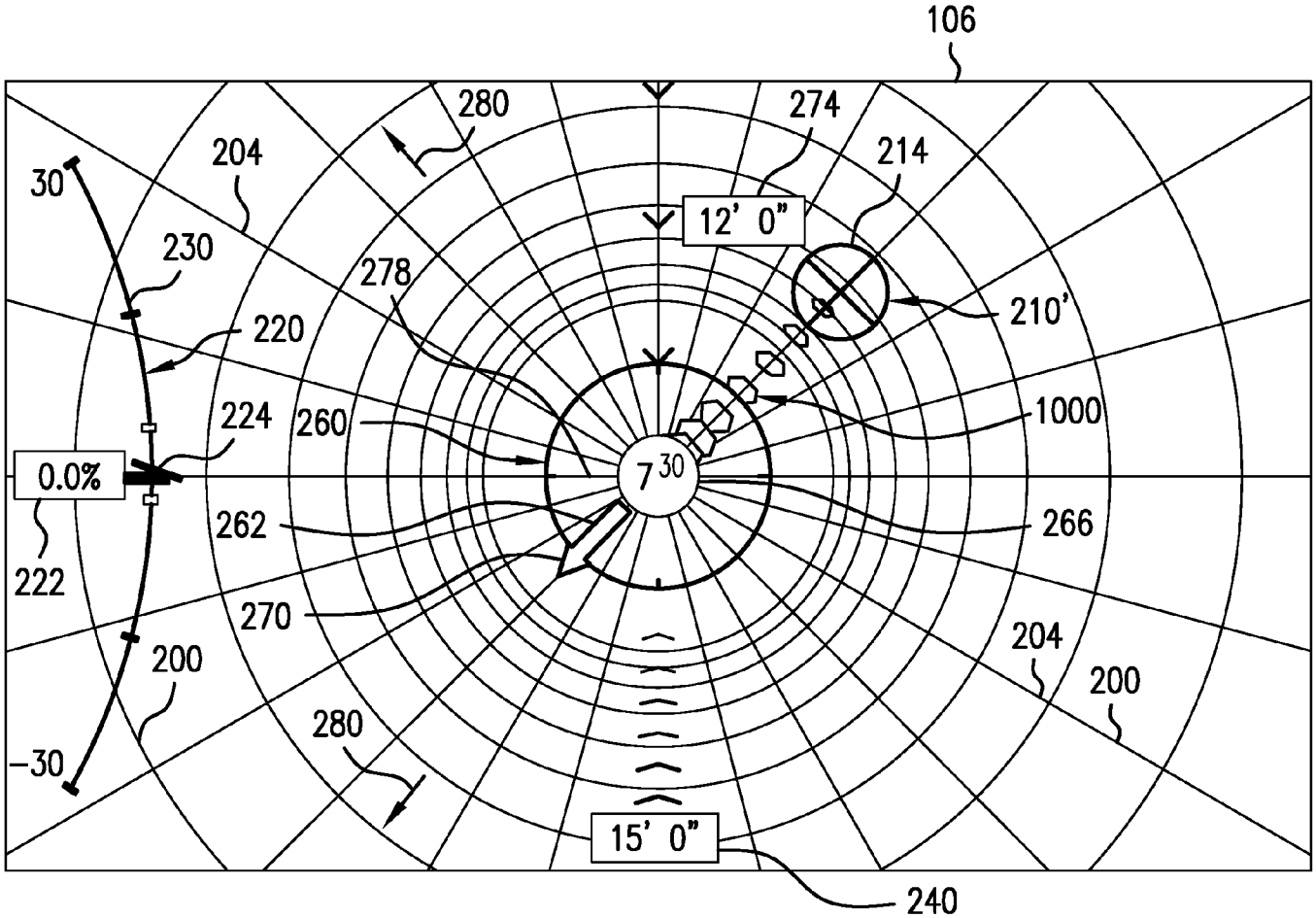
FIG. 10 is a diagrammatic screen shot illustrating the appearance of an embodiment of a rotate command wherein the steering indicator is centered and the target indicator moves around the steering indicator based on steering commands.

FIG. 10 is a diagrammatic illustration of the appearance of another embodiment of a target steering application as it can appear, for example, on display 106 of FIG. 1. It is noted that descriptions of some like components have not been repeated for purposes of brevity. In the present embodiment, the center of concentric circles 200 is centered upon roll gauge 260 with target symbol 210' being movable relative to the roll gauge (i.e., steering indicator 260) such that the frame of reference is reversed as compared to FIGS. 2-4. That is, the target symbol moves around the centered roll gauge in FIG. 10 based on the steering commands. Radial lines 204 extend from the center of the roll gauge, for example, in 15 degree increments. Concentric circles 200 and radial lines 204 can continue to cooperate to simulate the appearance of a three dimensional tunnel with similar animations applied to circles 200 responsive to forward and reverse movement of the boring tool. Target symbol 210' can include an intersecting X shape formed within circle 214. It is noted that the target symbol may be provided in a wide range of different configurations and is not limited to the described configuration. The target symbol moves relative to the center of circles 200 based on the steering commands during an ongoing drilling operation. In an embodiment, the relative size of the target symbol can change responsive to distance of the boring tool from the actual target position, as described above. Pitch gauge 220 is presented near the left edge of display 106 and can present the most recent or current pitch value received at the drill rig. In the example of FIG. 10, a value of 0.0% pitch is shown as the current pitch value. Current distance 240 from the target is shown as 15 feet, 0 inches, while current depth indication 274 shows a depth of 12 feet, 0 inches for the boring tool. A series of chevrons can align to point in the direction of the roll gauge from the distance indication.

Still referring to FIG. 10, in an embodiment, a series of hexagons 1000 leads from roll gauge 260 to target 210'. The diameter of each hexagon in the series can progressively decrease in size with increasing distance from the roll gauge/boring tool. In one feature, the angular orientation of each hexagon in the series can be determined based on the curvature of the drill string at an associated point on the drill path. In this way, the display intuitively illustrates 3-D curvature along the path. The use of hexagons is not intended as being limiting, any suitable symbol or symbols may be employed as representative of the drill path ahead. The drill path and its associated curvature can be established in any suitable manner such as, for example, based on a pre-planned intended path that is determined prior to drilling or determined on-the-fly. It is noted that the screen shot of FIG. 10 is analogous to the illustration of FIG. 2 by way of illustrating a rotate command. Of course, color schemes and/or animation can be utilized in a manner that is consistent with the descriptions above and with a great deal of flexibility while continuing to remain within the scope of the teachings that have been brought to light herein. One of ordinary skill in the art can readily implement a display corresponding to the push command of FIG. 3 having this overall disclosure in hand. A rotate command and/or push command consistent with FIG. 10 can readily be used in conjunction with the spin command of FIG. 4, to form the full set of commands, since the target and steering indicators are aligned for purposes of the spin command.

While the discussions above frame the indication of actuation commands primarily in terms of visual display, it should be appreciated that actuation commands can be communicated to the operator in any suitable manner. By way of non-limiting example, embodiments can utilize aural actuation commands, touch-based haptic actuation commands, resistance of drill rig controls such as, for example, control levers to operator actuations, vibration of drill rig controls to indicate appropriate and/or inappropriate controls for a particular actuation command or any suitable combinations thereof, including combinations that utilize a visual display.

The displays enabled by the foregoing descriptions are considered to provide for an intuitive representation of information that is relevant to the successful outcome of a particular drilling operation in the context of a homing or target steering system. It is submitted that such displays have not been seen heretofore. Progression of the drilling operation is monitored in a way that provides for issuing appropriate indications to the operator using a customized display mode for each indication that significantly enhances the likelihood of successful completion of a given drilling operation in the most expeditious manner. In particular, a display is configured to selectively and automatically provide indications as drill rig actuation commands to an operator including each of a rotate command, a push command and a spin command responsive at least in part to the steering commands. It should be appreciated that a set of one or more actuation commands can be provided that is sufficient to operate a given drill rig and that the actuation command set is not limited to the specific commands that have been described in detail herein. That is, the actuation command set can be customized in any desired way, for example, based on one or more of the actuation commands described herein, other actuation commands and/or any suitable combination of actuation commands. In an embodiment, at any given time during an overall drill run, the display can issue an appropriate one of the drill rig actuation commands. That is, the operator can always rely on the presence of guidance in the form of the current drill rig actuation command. In addition to indicating the drill rig actuation commands, the display can consolidate relevant information such as, for example, the current roll orientation of the boring tool into a steering indicator to provide an intuitive representation of the actual operational status of the drill rig and boring tool integral with and in view of the current drill rig actuation command. Moreover, the need for the operator to interpret or translate steering commands in conjunction with other information such as, for example, the current roll orientation of the boring tool to formulate appropriate drill rig actuations is effectively eliminated.

The foregoing description of the invention has been presented for purposes of illustration and description. It is not intended to be exhaustive or to limit the invention to the precise form or forms disclosed, and other modifications and variations may be possible in light of the above teachings wherein those of skill in the art will recognize certain modifications, permutations, additions and sub-combinations thereof.

What is claimed is:

1. In a system for performing horizontal directional drilling including a drill string extending from a drill rig to a boring tool such that the boring tool is steerable based on a roll orientation thereof, said system including an arrangement for generating steering commands for guiding the boring tool to a target position, an apparatus comprising:

a display configured to selectively indicate, responsive at least in part to the steering commands, rig actuation commands including each of a rotate command, a push command and a spin command such that at any given time during a drilling operation one of the rotate command, the push command and the spin command is issued to an operator of the system wherein execution of the rig actuation commands guides the boring tool to the target position.

2. The apparatus of claim 1 wherein the display is configured to visually indicate each of said rotate command, said push command and said spin command to the operator.

3. The apparatus of claim 1 wherein the display illustrates a steering indicator that is positioned on the display based on the steering commands and the steering indicator indicates said roll orientation of the boring tool.

4. The apparatus of claim 3 wherein the steering indicator graphically indicates the roll orientation on a clock face.

5. The apparatus of claim 3 wherein the steering indicator numerically indicates the roll orientation.

6. The apparatus of claim 1 wherein the system generates the steering commands including a vertical steering command and a horizontal steering command and wherein the display is configured to switch between indicating the spin command and each of the push command and the rotate command based on a threshold value of a magnitude of each of the vertical steering command and the horizontal steering command.

7. The apparatus of claim 1 wherein the display illustrates a steering indicator that is positioned on the display based on the steering commands and the steering indicator is configured to change in appearance while the spin command is issued as compared to the appearances of the push command and the rotate command.

8. The apparatus of claim 1 wherein the display illustrates a target indicator and the target indicator is configured to include a first diameter corresponding to the push command and the rotate command and a second, larger diameter corresponding to the spin command.

9. The apparatus of claim 8 wherein the display further illustrates a steering indicator and said display is configured to center the steering indicator on the target indicator responsive to both the vertical steering command and the horizontal steering command satisfying a threshold value of a magnitude of each of the vertical steering command and the horizontal steering command.

10. The apparatus of claim 1 wherein the target position is defined in fixed relation to a portable device that receives a locating signal from the boring tool.

11. The apparatus of claim 1 wherein the target position is a point along a predetermined bore plan which target position is defined in relation to a portable device that is located above ground.

12. In a system for performing horizontal directional drilling including a drill string extending from a drill rig to a boring tool such that the boring tool exhibits a pitch orientation and at least periodically transmits a pitch reading based on the pitch orientation and is steerable based on a roll orientation thereof, said system including an arrangement for generating steering commands for guiding the boring tool to a target position, an apparatus comprising:

a display configured to illustrate a steering indicator in a positional relationship with a target indicator on said display and said steering indicator is configured to present information that is representative of a current roll orientation of the boring tool using a set of predefined roll positions in conjunction with indicating a desired steering direction to steer the boring tool to the target position and the desired steering direction, as indicated, moves stepwise between the plurality of predefined roll positions responsive to the current roll orientation of the boring tool and the display is further configured to illustrate a current pitch orientation in conjunction with a pitch trend including a minimum pitch and a maximum pitch based on a plurality of the transmitted pitch readings.

13. The apparatus of claim 12 wherein the steering indicator graphically illustrates the current roll orientation on a clock face.

14. The apparatus of claim 12 wherein the steering indicator includes a roll bar that illustrates the current roll orientation.

15. The apparatus of claim 14 wherein the roll bar is configured for stepwise movement between the plurality of predefined roll positions on the clock face responsive to the current roll orientation of the boring tool.

16. The apparatus of claim 12 wherein the steering indicator numerically illustrates the current roll orientation of the boring tool.

17. The apparatus of claim 12 wherein the steering indicator includes a pitch horizon that indicates said current pitch orientation.

18. In a system for performing horizontal directional drilling including a drill string extending from a drill rig to a boring tool such that the boring tool is steerable based on a roll orientation thereof, said system including an arrangement for generating steering commands for guiding the boring tool to a target position, an apparatus comprising:

a display configured to illustrate a steering indicator in a positional relationship with a target indicator on said display and said steering indicator is configured to present information that is representative of a current roll orientation of the boring tool using a set of predefined roll positions in conjunction with indicating a desired steering direction to steer the boring tool to the target position and the desired steering direction, as indicated, moves stepwise between the plurality of predefined roll positions responsive to the current roll orientation of the boring tool and the target indicator is positionally fixed on the display and the steering indicator moves around the target indicator to present the positional relationship.

19. In a system for performing horizontal directional drilling including a drill string extending from a drill rig to a boring tool such that the boring tool is steerable based on a roll orientation thereof, said system including an arrangement for generating steering commands for guiding the boring tool to a target position, an apparatus comprising:

a display configured to illustrate a steering indicator in a positional relationship with a target indicator on said display and said steering indicator is configured to present information that is representative of a current roll orientation of the boring tool using a set of predefined roll positions in conjunction with indicating a desired steering direction to steer the boring tool to the target position and the desired steering direction, as indicated, moves stepwise between the plurality of predefined roll positions responsive to the current roll orientation of the boring tool and the steering indicator is positionally fixed on the display and the target indicator moves around the steering indicator to present the positional relationship.

20. The apparatus of claim 19 wherein the display is configured to illustrate a series of geometric shapes that lead from the steering indicator to the target indicator.

21. In a system for performing horizontal directional drilling including a drill string extending from a drill rig to a boring tool such that the boring tool is steerable based on a roll orientation thereof and said boring tool transmits a current roll orientation signal that exhibits a given resolution to define a set of predetermined, angularly spaced apart roll orientation positions each of which can be specified by the current roll orientation signal, an apparatus comprising:

an arrangement for generating a vertical steering command and a horizontal steering command such that a steering command ratio between the vertical steering command and the horizontal steering command defines a desired steering direction for guiding the boring tool to a target and the desired steering direction is not limited to said predetermined spaced apart roll orientations defined by the given resolution of the transmitter; and a display configured to illustrate a steering indicator in an offset positional relationship from a target indicator based on the steering commands and said steering indicator graphically presents a modified desired steering direction, that is based on the desired steering direction, at least when the desired steering direction falls between the predetermined spaced apart roll positions, and the modified steering direction corresponds to a nearest one of the predetermined roll orientation positions such that the modified desired steering direction angularly aligns with one of the predetermined spaced apart roll orientations.

22. In a system for performing horizontal directional drilling including a drill string extending from a drill rig to a boring tool such that the boring tool is steerable based on a roll orientation thereof and the system is configured to generate steering commands such that the boring tool can home in on a target, an apparatus comprising:

a display configured to illustrate a steering indicator in a positional relationship with a target indicator based on the steering commands; and a grid pattern illustrated on the display and originating on a selected one of the target indicator and the steering indicator such that the grid pattern includes a plurality of elements and at least some elements of the grid pattern are configured to move responsive to movement of the boring tool toward the target.

23. The apparatus of claim 22 wherein the grid pattern diagrammatically represents a three dimensional tunnel structure.

24. The apparatus of claim 23 wherein the grid pattern is configured such that movement of said elements mimics movement of the boring tool within the three dimensional tunnel structure.

25. In a system for performing horizontal directional drilling including a drill string extending from a drill rig to a boring tool such that the boring tool is steerable based on a roll orientation thereof, said system including an arrangement for generating steering commands for guiding the boring tool to a target position, a method comprising:

selectively visually indicating, responsive at least in part to the steering commands, rig actuation commands including each of a rotate command, a push command and a spin command such that at any given time during a drilling operation one of the rotate command, the push command and the spin command is issued to an operator of the system wherein execution of the rig actuation commands guides the boring tool to the target position.

* * * * *